US012420211B2

(12) United States Patent
Dong

(10) Patent No.: US 12,420,211 B2
(45) Date of Patent: Sep. 23, 2025

(54) ROLY-POLY TOY WITH ADJUSTABLE CENTER OF GRAVITY

(71) Applicant: Lin Dong, Qiyang (CN)

(72) Inventor: Lin Dong, Qiyang (CN)

( * ) Notice: Subject to any disclaimer, the term of this patent is extended or adjusted under 35 U.S.C. 154(b) by 196 days.

(21) Appl. No.: 18/275,812

(22) PCT Filed: Nov. 8, 2021

(86) PCT No.: PCT/CN2021/129406
§ 371 (c)(1),
(2) Date: Aug. 4, 2023

(87) PCT Pub. No.: WO2022/213595
PCT Pub. Date: Oct. 13, 2022

(65) Prior Publication Data

US 2024/0123364 A1 Apr. 18, 2024

(30) Foreign Application Priority Data

Apr. 9, 2021 (CN) ..... 202110383507.X

(51) Int. Cl.
*A63H 15/06* (2006.01)

(52) U.S. Cl.
CPC ..... *A63H 15/06* (2013.01)

(58) Field of Classification Search
CPC ..... A63H 15/06; A63H 29/22
USPC ..... 446/241, 325, 326, 351, 396
See application file for complete search history.

(56) References Cited

U.S. PATENT DOCUMENTS 3,921,331 A * 11/1975 Schatz ..... A63H 3/28 446/297
5,169,354 A * 12/1992 Norton ..... A63H 1/06 446/241
7,258,591 B2 * 8/2007 Xu ..... A63H 33/26 446/379
11,844,161 B2 * 12/2023 Inoko ..... F21S 2/00
2005/0272343 A1 * 12/2005 Lee ..... B44C 5/005 446/71

(Continued)

FOREIGN PATENT DOCUMENTS

CN 101279447 B * 7/2010
CN 101386174 B * 8/2010
CN 201940028 U * 8/2011

(Continued)

*Primary Examiner* — Alexander R Niconovich
(74) *Attorney, Agent, or Firm* — Bayramoglu Law Offices LLC

(57) ABSTRACT

A roly-poly toy with adjustable center of gravity, comprising a first and second base part arranged at an interval, a first winding mandrel mounted on the first base part, a second winding mandrel mounted on the second base part, a reel belt, and a drive assembly. The reel belt is annular and has a first end wound around the first winding mandrel and a second end wound around the second winding mandrel. The drive assembly can switch between a first driving state and a second driving state. When the drive assembly is in the first driving state, the first winding mandrel rotates to roll up the reel belt, and the second winding mandrel rotates to release the reel belt. When it is in the second driving state, the second winding mandrel rotates to roll up the reel belt, and the first winding mandrel rotates to release the reel belt.

20 Claims, 7 Drawing Sheets

(56) References Cited

U.S. PATENT DOCUMENTS

| | | | | | |
|---|---|---|---|---|---|
| 2016/0001192 | A1* | 1/2016 | Wang | ..... | A63H 33/22<br>446/396 |

FOREIGN PATENT DOCUMENTS

| | | | | | | |
|---|---|---|---|---|---|---|
| CN | 202983178 | U | * | 6/2013 | | |
| CN | 103083914 | B | * | 6/2016 | | |
| CN | 105664498 | A | | 6/2016 | | |
| CN | 105664499 | A | * | 6/2016 | ..... | A63H 29/22 |
| CN | 105688415 | A | * | 6/2016 | ..... | A63H 29/22 |
| CN | 105869475 | A | * | 8/2016 | ..... | G09B 19/00 |
| CN | 206653779 | U | * | 11/2017 | | |
| CN | 105664498 | B | * | 12/2017 | ..... | A63H 15/06 |
| CN | 107596699 | A | * | 1/2018 | | |
| CN | 108786135 | A | * | 11/2018 | ..... | A63H 33/22 |
| CN | 108939568 | A | * | 12/2018 | ..... | A63H 15/06 |
| CN | 108939569 | A | * | 12/2018 | ..... | A63H 29/22 |
| CN | 112973142 | A | | 6/2021 | | |
| CN | 214808404 | U | | 11/2021 | | |
| JP | 3241761 | U | * | 4/2023 | | |
| KR | 200462932 | Y1 | * | 10/2012 | ..... | A63H 15/04 |
| TW | 465371 | U | | 11/2001 | | |
| TW | M484454 | U | * | 8/2014 | | |

* cited by examiner

ROLY-POLY TOY WITH ADJUSTABLE CENTER OF GRAVITY

CROSS-REFERENCES TO THE RELATED APPLICATIONS

This application is the national phase entry of International Application No. PCT/CN2021/129406, filed on Nov. 8, 2021, which is based upon and claims priority to Chinese Patent Application No. 202110383507.X, filed on Apr. 9, 2021, the entire contents of which are incorporated herein by reference.

TECHNICAL FIELD

The disclosure relates to the technical field of entertainment devices, more particularly to a roly-poly toy with adjustable center of gravity.

BACKGROUND

Existing roly-poly toys which have overweight base parts cannot meet requirements of users of all ages. As their mechanical structures provide base parts and upper parts having unchangeable weights, users of different ages need corresponding types of roly-poly toys in different specifications. Thus, existing roly-poly toys are merely applicable for particular users and have high costs. They cannot meet requirements of users of various ages and thus have poor versatility.

SUMMARY

Aiming at existing technical problems in the art, an object of the disclosure is to provide a roly-poly toy with adjustable center of gravity, which can change the center of gravity of the roly-poly toy by changing the weights of the reel belt applied to the first winding mandrel and to the second winding mandrel, thereby providing the roly-poly toy which can amuse users of different ages.

In order to achieve the above goal, the disclosure provides a technical solution as follows.

A roly-poly toy with adjustable center of gravity comprises a first base part, a first winding mandrel rotatably mounted on the first base part, a second base part, a second winding mandrel rotatably mounted on the second base part, a reel belt, and a drive assembly; wherein the first base part and the second base part are arranged at an interval, the reel belt is annular and has a first end wound around the first winding mandrel and a second end wound around the second winding mandrel;

wherein the drive assembly is configured to switch between a first driving state and a second driving state, when the drive assembly is in the first driving state, the first winding mandrel rotates to roll up the reel belt, and the second winding mandrel rotates to release the reel belt, and when the drive assembly is in the second driving state, the second winding mandrel rotates to roll up the reel belt, and the first winding mandrel rotates to release the reel belt.

Furthermore, the roly-poly toy with adjustable center of gravity may further comprise a first guiding shaft and a second guiding shaft, both of which are mounted on the first base part, wherein the first winding mandrel may be disposed between the first guiding shaft and the second guiding shaft, the reel belt on one side at the first end may extend over the first guiding shaft and abut against a circumference surface of the first guiding shaft, and the reel belt on another side at the first end may extend over the second guiding shaft and abut against a circumference surface of the second guiding shaft.

Furthermore, the roly-poly toy with adjustable center of gravity may further comprise a third guiding shaft and a fourth guiding shaft, both of which are mounted on the second base part, wherein the second winding mandrel may be disposed between the third guiding shaft and the fourth guiding shaft, the reel belt on one side at the second end may extend over the third guiding shaft and abut against a circumference surface of the third guiding shaft, and the reel belt on another side at the second end may extend over the fourth guiding shaft and abut against a circumference surface of the fourth guiding shaft.

Furthermore, the roly-poly toy with adjustable center of gravity may further comprise a first rotating rack and a second rotating rack, both of which are rotatably mounted on the first base part, a rotation axis of the first winding mandrel, a rotation axis of the first rotating rack, and a rotation axis of the second rotating rack may be parallel to each other, the first guiding shaft may be mounted on the first rotating rack in such a manner that an axis of the first guiding shaft is perpendicular to the rotation axis of the first rotating rack, and the second guiding shaft may be mounted on the second rotating rack in such a manner that an axis of the second guiding shaft is perpendicular to the rotation axis of the second rotating rack.

Furthermore, the roly-poly toy with adjustable center of gravity may further comprise a third rotating rack and a fourth rotating rack, both of which are rotatably mounted on the second base part, a rotation axis of the second winding mandrel, a rotation axis of the third rotating rack, and a rotation axis of the fourth rotating rack may be parallel to each other, the third guiding shaft may be mounted on the third rotating rack in such a manner that an axis of the third guiding shaft is perpendicular to the rotation axis of the third rotating rack, and the fourth guiding shaft may be mounted on the fourth rotating rack in such a manner that an axis of the fourth guiding shaft is perpendicular to the rotation axis of the fourth rotating rack.

Furthermore, the first base part may be arranged with a positioning seat, the drive assembly may comprise a drive shaft rotatably mounted on the positioning seat, a first synchronous wheel connected to and coaxially rotatable with the drive shaft, a second synchronous wheel and a third synchronous wheel which are rotatably mounted on the positioning seat, a first synchronous belt, a fourth synchronous wheel mounted on the second winding mandrel and synchronously rotatable with the second winding mandrel, a fifth synchronous wheel and a sixth synchronous wheel which are rotatably mounted on the second base part, and a second synchronous belt; the drive shaft may be connected to and coaxially rotatable with the first winding mandrel, the second synchronous wheel may be connected and synchronously rotatable with the fifth synchronous wheel, and the third synchronous wheel may be connected and synchronously rotatable with the sixth synchronous wheel;

wherein the first synchronous belt may be annular shaped and have one end engaged to the second synchronous wheel and another end engaged to the third synchronous wheel, the first synchronous wheel may be located between the second synchronous wheel and the third synchronous wheel, within an area surrounded by the first synchronous belt, and the first synchronous wheel may be engaged with an inside of the first synchronous belt; and wherein the second synchronous belt may be annular shaped and have one end engaged to the fifth synchronous wheel and another end engaged to the sixth synchronous wheel, the fourth synchronous wheel may be located between the fifth synchronous wheel and the sixth synchronous wheel, within an area surrounded by the second synchronous belt, and the fourth synchronous wheel may be engaged with an inside of the second synchronous belt.

Furthermore, the drive assembly may further comprise a slide slideably mounted on the positioning seat, wherein the slide may be slideable in a direction along an axis of the drive shaft, the slide may be provided with a first limiting groove, a first groove portion, a second groove portion, and a second limiting groove, which are disposed and in communication in this order in the direction along the axis of the drive shaft, the drive shaft may extend through the first limiting groove, the first groove portion, the second groove portion, and the second limiting groove in this order; a first mounting seat may be disposed inside the first limiting groove, a second mounting seat may be disposed inside the second limiting groove, the first mounting seat may be rotatably mounted in the first limiting groove, and the second mounting seat may be rotatably mounted in the second limiting groove, wherein the drive shaft may be provided at a circumference surface with a snap-in column located between the first mounting seat and the second mounting seat, the first winding mandrel may be arranged with a rotatable plate which is fixedly connected to and coaxially rotatable with the first winding mandrel, an end surface of the rotatable plate may be provided with a first engagement groove, an end surface of the first synchronous wheel may be provided with a second engagement groove, the first mounting seat may be arranged with a first engagement piece for engagement with the first engagement groove, and the second mounting seat may be arranged with a second engagement piece for engagement with the second engagement groove;

a wall formed between the first groove portion and the second groove portion may be provided with a communication path for communicating the first groove portion with the second groove portion, the communication path may have a first side wall and a second side wall which are opposite to each other, a first straight shaft may be arranged on the first side wall and sleeved with a first torsion spring, a second straight shaft may be arranged on the second side wall and sleeved with a second torsion spring, a first guiding plate may be mounted on the first straight shaft, with one end of the first guiding plate being rotatably mounted on the first straight shaft and another end of the first guiding plate extending into the first groove portion, a distance from a wall formed between the first limiting groove and the first groove portion to the first guiding plate may be less than a diameter of the snap-in column, and the first guiding plate may be arranged to tilt towards the axis of the drive shaft; wherein a second guiding plate may be mounted on the second straight shaft, with one end of the second guiding plate being rotatably mounted on the second straight shaft and another end of the second guiding plate extending into the second groove portion, a distance from a wall formed between the second groove portion and the second limiting groove to the second guiding plate may be less than the diameter of the snap-in column, and the second guiding plate may be arranged to tilt towards the axis of the drive shaft; the first guiding plate and the second guiding plate may be parallel to each other, one end of the first torsion spring may be fixedly connected with the first side wall, and another end of the first torsion spring may be fixedly connected with the first guiding plate, one end of the second torsion spring may be fixedly connected with the second side wall, and another end of the second torsion spring may be fixedly connected with the second guiding plate;

wherein the snap-in column may be movable between the first groove portion and the second groove portion via the communication path, and when the snap-in column is located in the first groove portion, the first engagement piece may be disengaged from the first engagement groove and the second engagement piece may be engaged within the second engagement groove; and when the snap-in column is located in the second groove portion, the first engagement piece may be engaged within the first engagement groove, and the second engagement piece may be disengaged from the second engagement groove.

Furthermore, an end surface of the first mounting seat may be provided with a first mounting groove, in which a first compression spring is mounted, with one end of the first compression spring being fixedly connected with a bottom wall of the first mounting groove, and another end of the first compression spring being fixedly connected with the first engagement piece, and an end surface of the second mounting seat may be provided with a second mounting groove, in which a second compression spring is mounted, with one end of the second compression spring being fixedly connected with a bottom wall of the second mounting groove, and another end of the second compression spring being fixedly connected with the second engagement piece.

Furthermore, the roly-poly toy with adjustable center of gravity may further comprise a mounting frame, wherein the drive assembly may further comprise a first connecting column and a second connecting column, the second synchronous wheel may be connected with the fifth synchronous wheel by the first connecting column, the third synchronous wheel may be connected with the sixth synchronous wheel by the second connecting column, one end of the mounting frame may be fixedly connected with the second base part, and another end of the mounting frame may be fixedly connected with the positioning seat, the mounting frame may be provided with a belt groove which allows the reel belt to pass along, a first column groove for mounting the first connecting column, and a second column groove for mounting the second connecting column.

Furthermore, the drive assembly may further comprise a handle rotatably mounted on the positioning seat, and the drive shaft and the handle are connected to and coaxially rotatable with each other.

Furthermore, the roly-poly toy with adjustable center of gravity may further comprise a dust cover covered on the second base part.

In a particular embodiment, the roly-poly toy with adjustable center of gravity may further comprise a stop block, and a second end of the reel belt may be located between the stop block and the second base part.

Compared with the existing technologies, the disclosure has advantages as follows. It can change the center of gravity of the roly-poly toy by changing the weights of the reel belt applied to the first winding mandrel and to the second winding mandrel, i.e., the weights of the lower portion and the upper portion of the roly-poly toy, thereby providing the roly-poly toy which can amuse users of different ages. Further, the center of gravity of the roly-poly toy can be manually adjusted. Thus, the disclosure has a simple structure and reduced maintenance cost and use cost than automatically adjusted ones. Hence, the disclosure provides the roly-poly toy which meets requirements of users of various ages and have good versatility at very low use cost.

Figure 1:
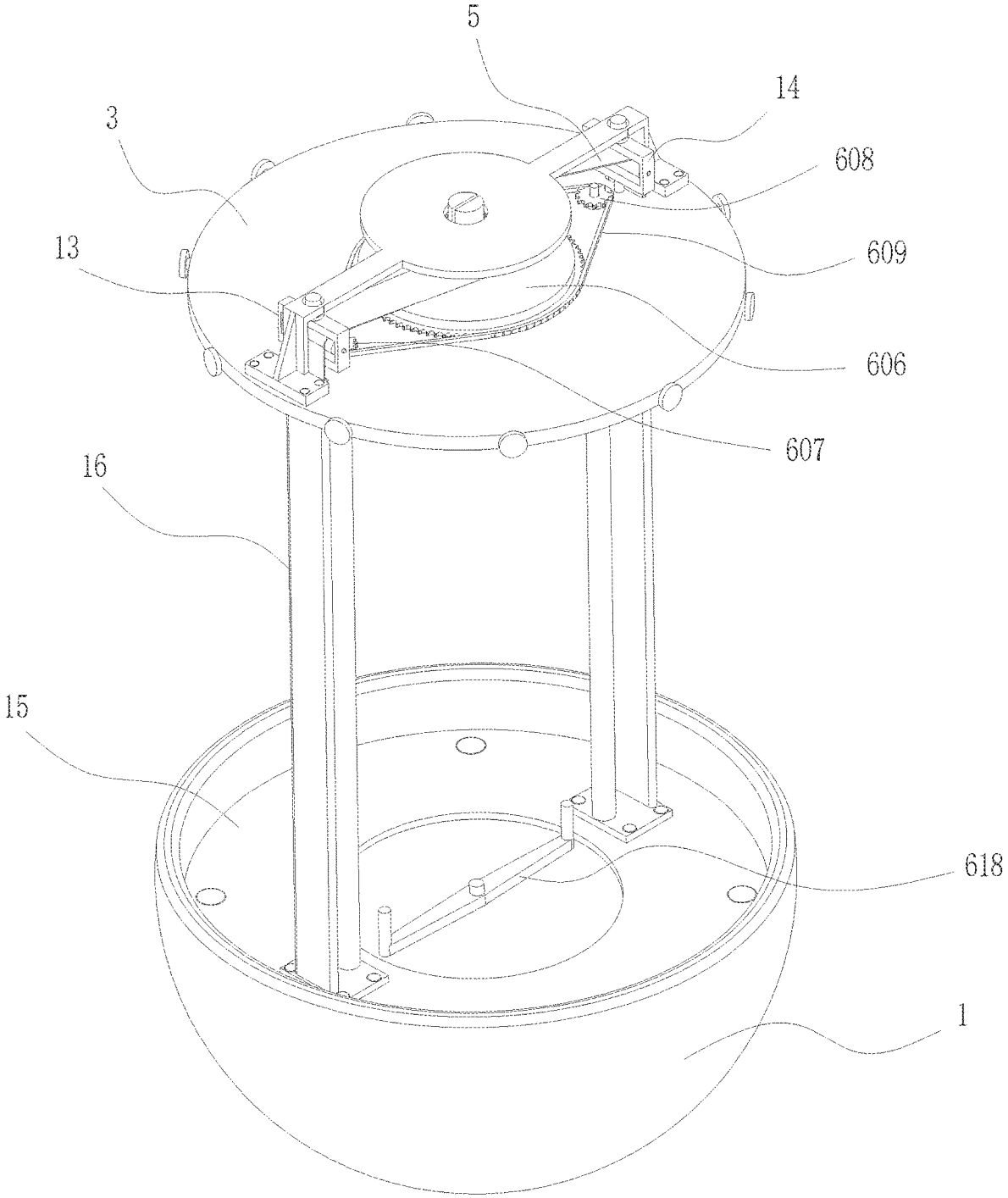
FIG. 1 is a schematic view of a roly-poly toy with adjustable center of gravity of the disclosure, in which a dust cover is omitted.

In the drawings: 1. first base part; 2. first winding mandrel; 3. second base part; 4. second winding mandrel; 5. reel belt; 6. drive assembly; 7. first guiding shaft; 8. second guiding shaft; 9. third guiding shaft; 10. fourth guiding shaft; 11. first rotating rack; 12. second rotating rack; 13. third rotating rack; 14. fourth rotating rack; 15. positioning seat; 16. mounting frame; 17. dust cover;

601. drive shaft; 602. first synchronous wheel; 603. second synchronous wheel; 604. third synchronous wheel; 605. first synchronous belt; 606. fourth synchronous wheel; 607. fifth synchronous wheel; 608. sixth synchronous wheel; 609. second synchronous belt; 610. slide; 611. first mounting seat; 612. second mounting seat; 613. snap-in columns; 614. first guiding plate; 615. second guiding plate; 616. first connecting column; 617. second connecting column; 618. handles; 619. first engagement piece; 620. second engagement piece; 621. rotatable plate;

6101. first limiting groove; 6102. first groove portion; 6103. second groove portion; 6104. second limiting groove; 6105. communication paths.

DETAILED DESCRIPTION OF ILLUSTRATED EMBODIMENTS

The embodiments of the disclosure will be further explained below in detail with reference to drawings and embodiments. The embodiments are illustrative and are not intended to limit the scope of the invention.

It should be noted that, unless explicitly stated or limited otherwise, terms such as "mount", "couple", "connect" and "communicate" in the description should be understood broadly. For example, it may refer to fixedly connection, or detachably connection, or integrally connection; it may refer to mechanically connection, or electrically connection; directly connection, or indirectly connection by a medium, or internally communication of two components. Those skilled in the art may understand particular meanings of the terms in the description according to specific circumstances.

For convenience of description, unless otherwise stated, upper and lower directions mentioned below refer to upper and lower directions as shown in FIG. 1, left and right directions mentioned below refer to left and right directions as shown in FIG. 1, the clockwise direction mentioned below refers to the direction in which the first winding mandrel rotates in clockwise direction when viewed from above to bottom as shown in FIG. 1, and the counterclockwise direction mentioned below refers to the direction in which the first winding mandrel rotates in counterclockwise direction when viewed from above to bottom as shown in FIG. 1.

Figure 2:
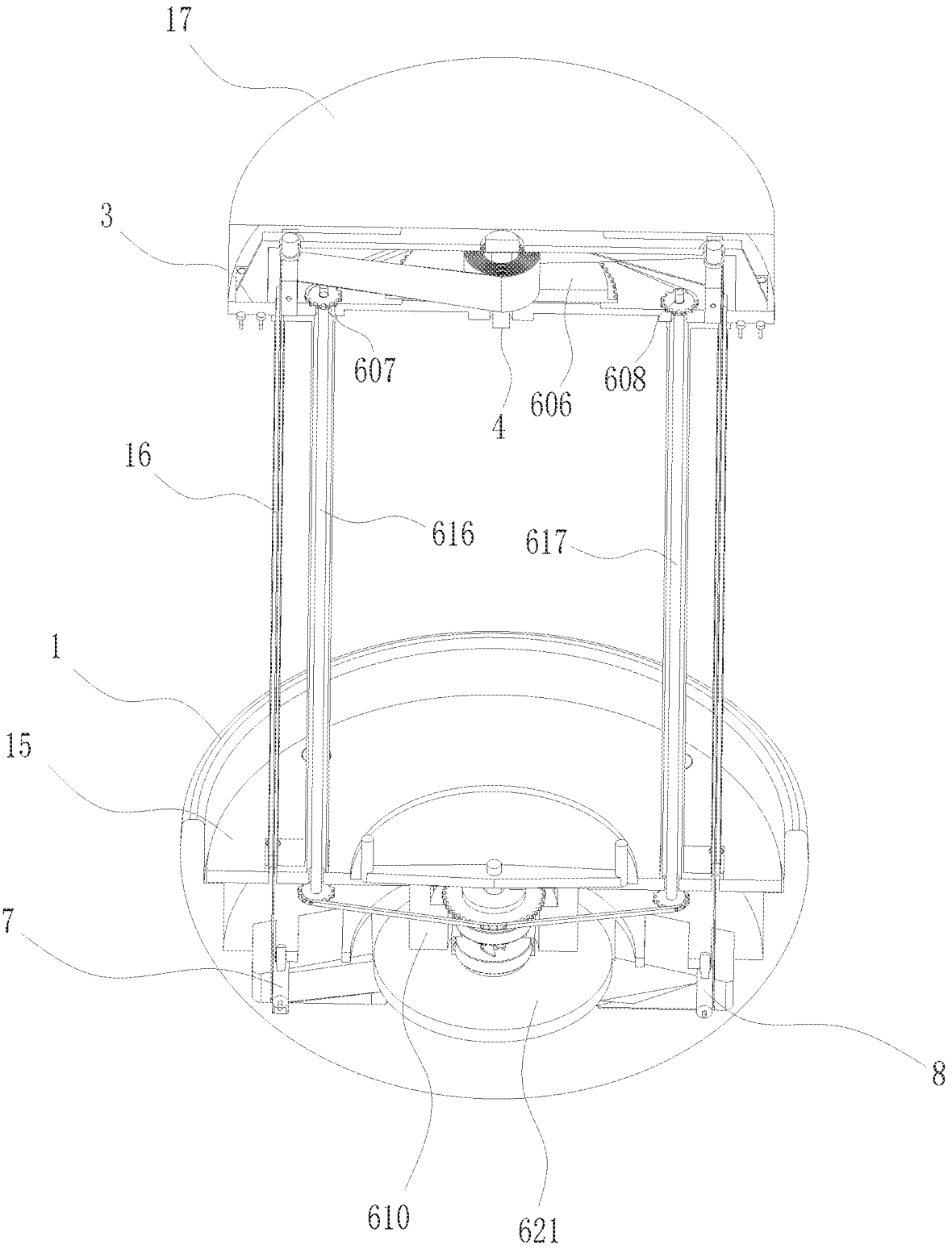
FIG. 2 is a semi-sectional view of a roly-poly toy with adjustable center of gravity of the disclosure.
Figure 3:
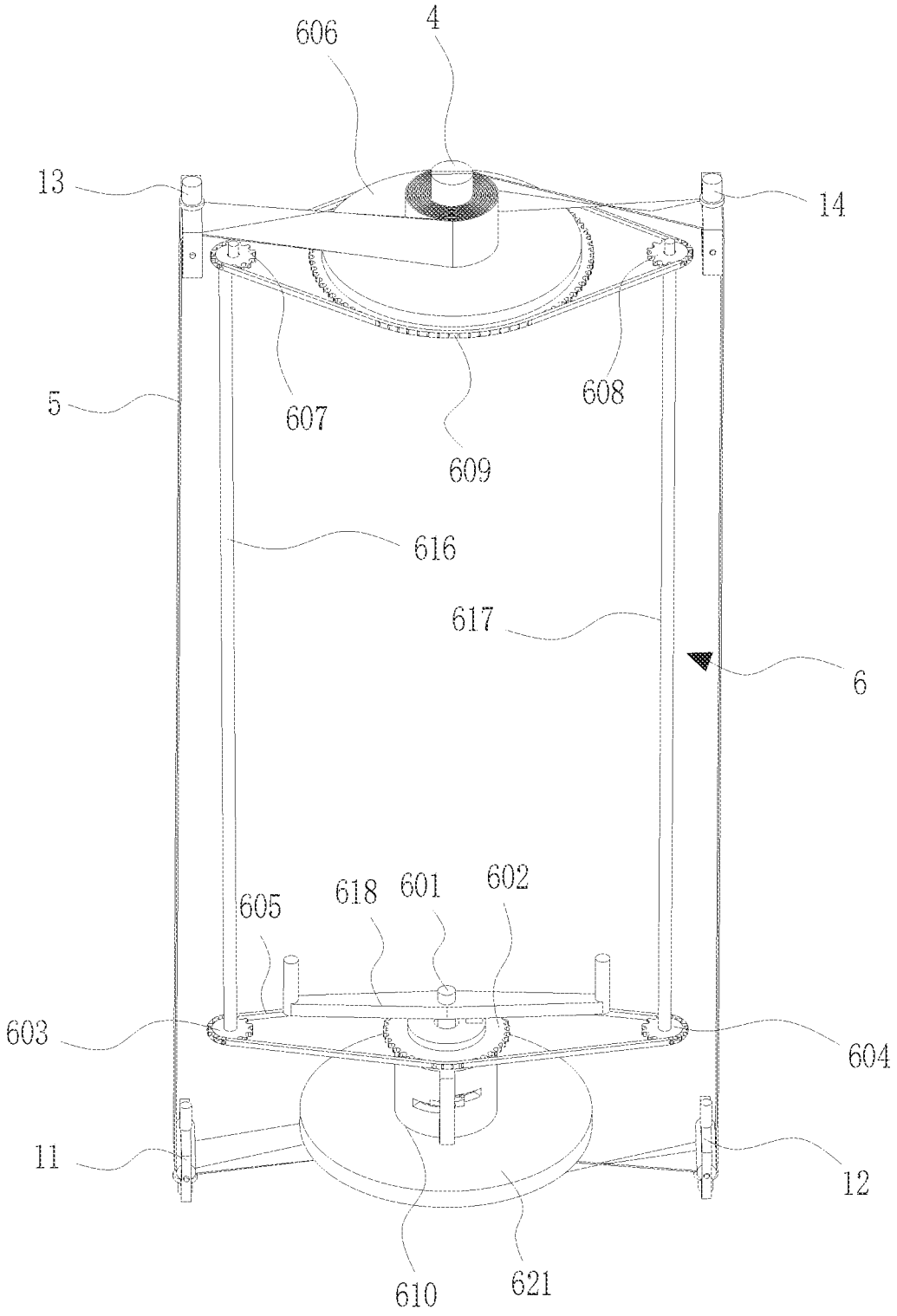
FIG. 3 is a schematic view illustrating a second winding mandrel, a drive assembly, and a reel belt.
Figure 4:
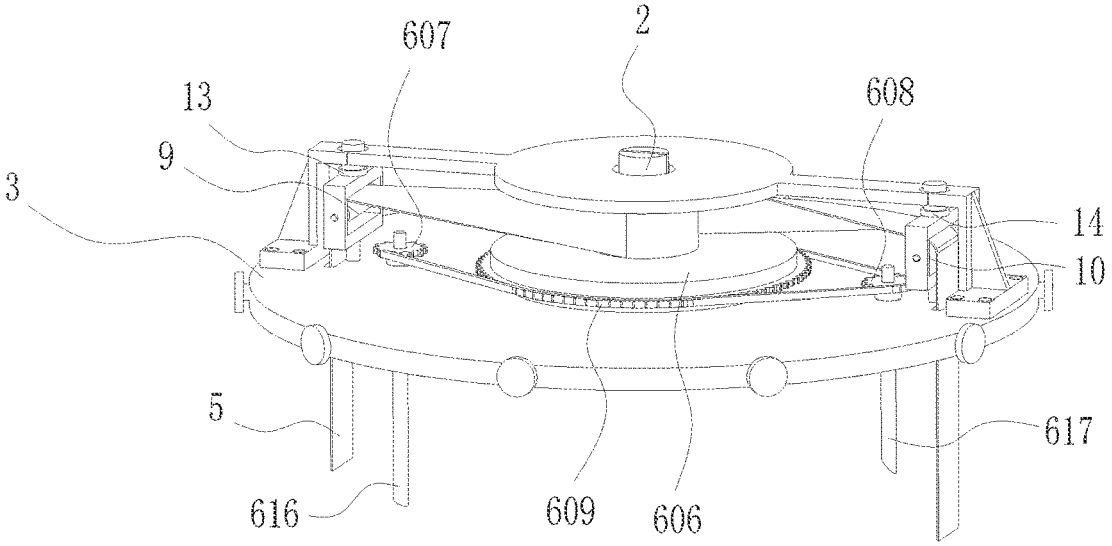
FIG. 4 is a schematic view illustrating a second base part, a second winding mandrel, a reel belt, a third rotating rack, and a fourth rotating rack.
Figure 5:
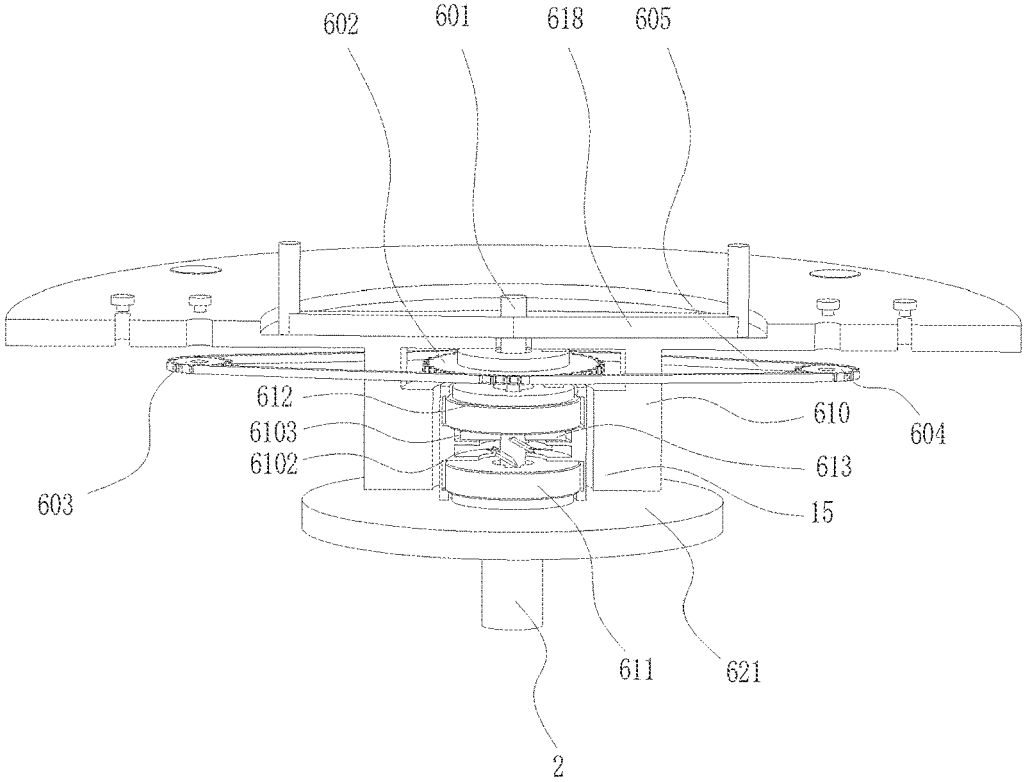
FIG. 5 is a schematic view illustrating a first base part, a positioning seat, a slide, a drive shaft, a first synchronous wheel, a second synchronous wheel, a third synchronous wheel, a first synchronous belt.
Figure 6:
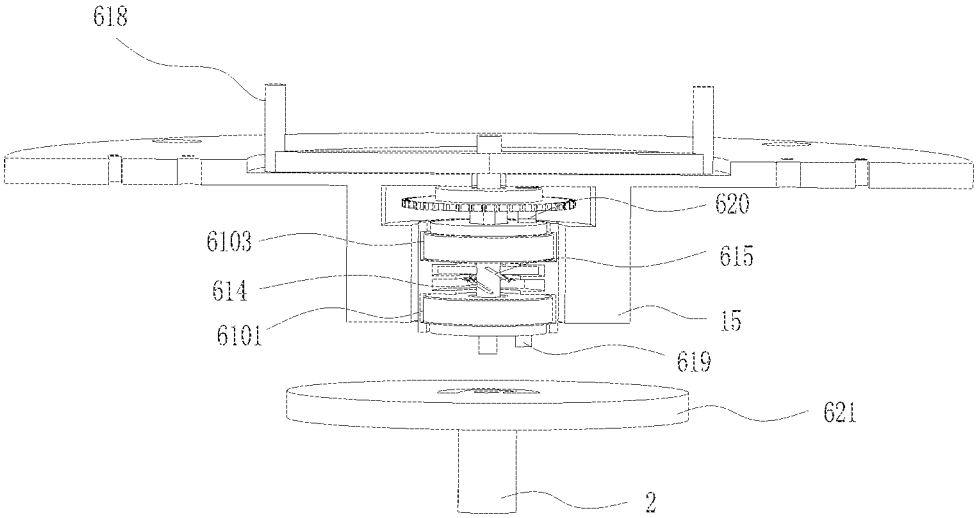
FIG. 6 is an exploded view of FIG. 5.
Figure 7:
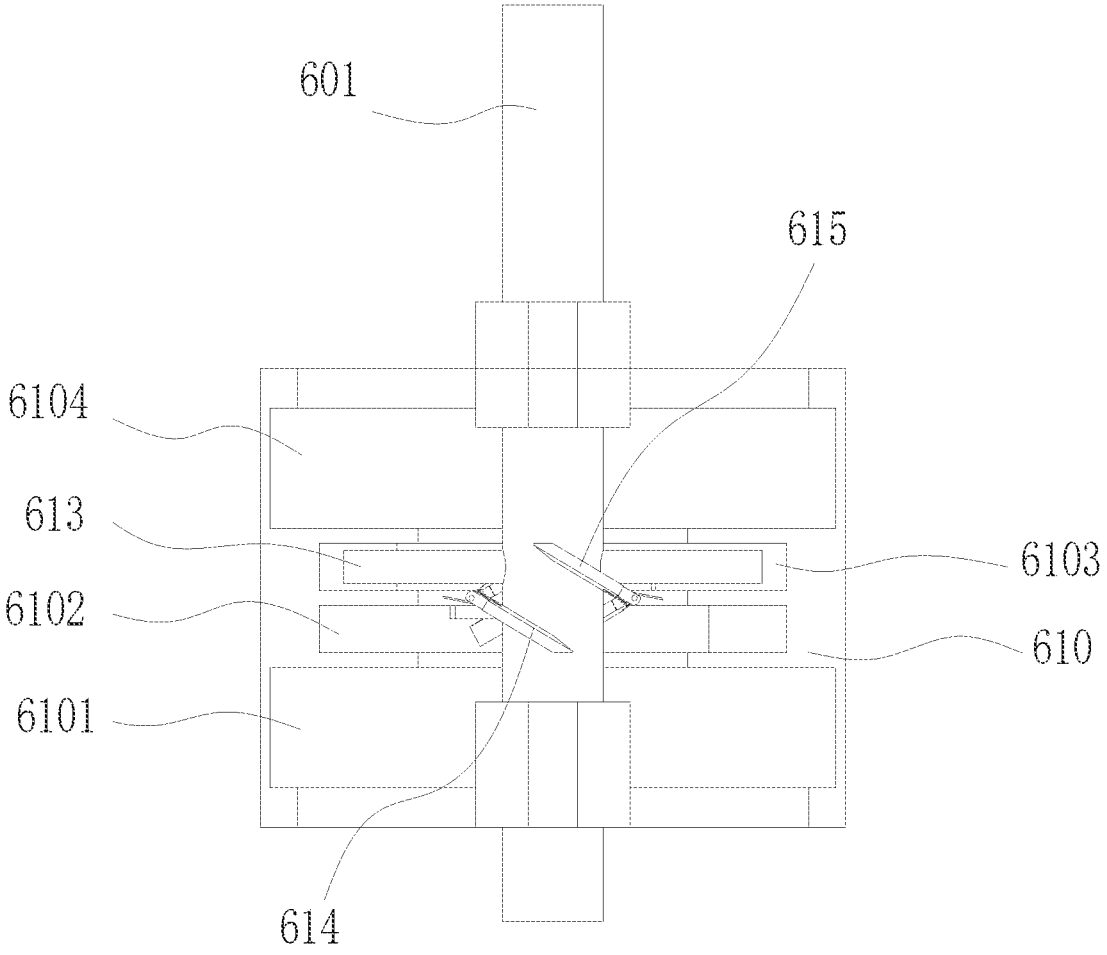
FIG. 7 is a semi-sectional view illustrating a drive shaft and a slide.
Figure 8:
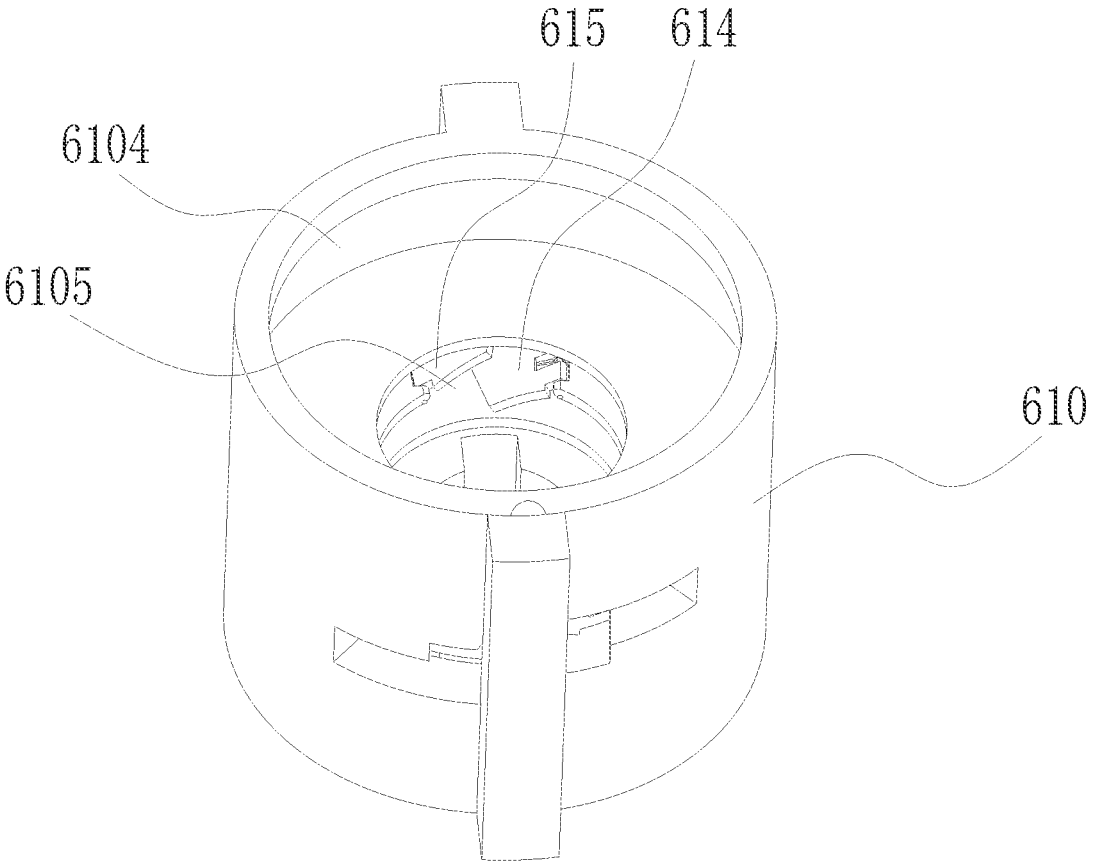
FIG. 8 is a schematic view of a slide.

Referring to FIGS. 1-3, the roly-poly toy with adjustable center of gravity in the embodiment comprises a first base part 1, a first winding mandrel 2 rotatably mounted on the first base part 1, a second base part 3, a second winding mandrel 4 rotatably mounted on the second base part 3, a reel belt 5, and a drive assembly 6. Herein, the first base part 1 and the second base part 3 are arranged at an interval. The reel belt 5 is annular. It has a first end and a second end. The first end (the lower end) of the reel belt 5 is wound around the first winding mandrel 2, and the second end (the upper end) of the reel belt 5 is wound around the second winding mandrel 4. The first base part 1 is placed right below the second base part 3. The first base part 1 is hemispherical and is provided with a hemispherical cavity, and the first winding mandrel 2 is disposed in the hemispherical cavity. The axes of the first winding mandrel 2 and of the second winding mandrel 4 are vertically arranged and lie on a same straight line.

The drive assembly 6 is configured to switch between a first driving state and a second driving state. When the drive assembly 6 is in the first driving state, the drive assembly 6 directly drives the first winding mandrel 2 to rotate and roll up the reel belt 5. As the first winding mandrel 2 rolls up the reel belt 5, it pulls the reel belt 5, such that the second winding mandrel 4 is rotated to release the reel belt 5, allowing the reel belt 5 to wind around the first winding mandrel 2. In such a manner, the gravity force acting on the first base part 1 increases, and the center of gravity of the roly-poly toy moves downward. The more the first winding mandrel 2 is rotated, the greater the gravity force acting on the first base part 1 is, and the greater the force required for pushing the roly-poly toy is. When the drive assembly 6 is in the second driving state, the drive assembly 6 directly drives the second winding mandrel 4 to rotate and roll up the reel belt 5. As the second winding mandrel 4 rolls up the reel belt 5, it pulls the reel belt 5, such that the first winding mandrel 2 is rotated to release the reel belt 5, allowing the reel belt 5 to wind around the second winding mandrel 4. In such a manner, the gravity force acting on the second base part 3 increases, and the center of gravity of the roly-poly toy moves upward. The more the second winding mandrel 4 is rotated, the less the gravity force acting on the first base part 1 is, and the less the force required for pushing the roly-poly toy is.

In a particular embodiment, the reel belt 5 may be a tape, a chain, or a rope.

In a particular embodiment, the roly-poly toy with adjustable center of gravity further comprises a first guiding shaft 7, a second guiding shaft 8. Herein, the first guiding shaft 7 and the second guiding shaft 8 are mounted on the first base part 1. The first winding mandrel 2 is disposed between the first guiding shaft 7 and the second guiding shaft 8. The reel belt 5 is arranged in such a manner that a portion of the reel belt 5 on one side at the first end travels over the first guiding shaft 7 and abuts against the outer circumference surface of the first guiding shaft 7, and a portion of the reel belt 5 on the other side at the first end travels over the second guiding shaft 8 and abuts against the outer circumference surface of the second guiding shaft 8. The axes of the first guiding shaft 7 and the second guiding shaft 8 are horizontally arranged and are perpendicular to the first winding mandrel 2. The reel belt 5 is guided in such a manner that the portion of the reel belt 5 on the one side at the first end horizontally extends and travels over the first guiding shaft 7, and then rotates ninety degrees and extends upward, and the portion of the reel belt 5 on the other side at the first end horizontally extends and travels over the second guiding shaft 8, and then rotates ninety degrees and extends upward.

In a particular embodiment, the roly-poly toy with adjustable center of gravity further comprises a third guiding shaft 9, and a fourth guiding shaft 10. Herein, both the third guiding shaft 9 and the fourth guiding shaft 10 are mounted on the second base part 3. The second winding mandrel 4 is disposed between the third guiding shaft 9 and the fourth guiding shaft 10. The reel belt 5 is arranged in such a manner that a portion of the reel belt 5 on one side at the second end travels over the third guiding shaft 9 and abuts against the outer circumference surface of the third guiding shaft 9, and a portion of the reel belt 5 on the other side at the second end travels over the fourth guiding shaft 10 and abuts against the outer circumference surface of the fourth guiding shaft 10. The axes of the third guiding shaft 9 and the fourth guiding shaft 10 are horizontally arranged and are perpendicular to the second winding mandrel 4. The reel belt 5 is guided in such a manner that the portion of the reel belt 5 on the one side at the second end horizontally extends and travels over the third guiding shaft 9, and then rotates ninety degrees and extends downward, and the portion of the reel belt 5 on the other side at the second end horizontally extends and travels over the fourth guiding shaft 10, and then rotates ninety degrees and extends downward.

In a particular embodiment, the roly-poly toy with adjustable center of gravity further comprises a first rotating rack 11 and a second rotating rack 12, both of which are rotatably mounted on the first base part 1. The rotation axis of the first winding mandrel 2, the rotation axis of the first rotating rack 11, and the rotation axis of the second rotating rack 12 are parallel to each other. The first guiding shaft 7 is rotatably mounted on the first rotating rack 11 in such a manner that the axis of the first guiding shaft 7 is perpendicular to the rotation axis of the first rotating rack 11. The second guiding shaft 8 is rotatably mounted on the second rotating rack 12 in such a manner that the axis of the second guiding shaft 8 is perpendicular to the rotation axis of the second rotating rack 12. The rotation axes of the first rotating rack 11 and the second rotating rack 12 are vertically arranged. The first winding mandrel 2 is disposed between the first rotating rack 11 and the second rotating rack 12. By rotating the first rotating rack 11 and the second rotating rack 12, the guiding angles of the first guiding shaft 7 and the second guiding shaft 8 can be adjusted, such that rotation angle and turning angle of the reel belt 5 can be changed.

In a particular embodiment, the roly-poly toy with adjustable center of gravity further comprises a third rotating rack 13 and a fourth rotating rack 14, both of which are rotatably mounted on the second base part 3. The rotation axis of the second winding mandrel 4, the rotation axis of the third rotating rack 13, and the rotation axis of the fourth rotating rack 14 are parallel to each other. The third guiding shaft 9 is rotatably mounted on the third rotating rack 13 in such a manner that the axis of the third guiding shaft 9 is perpendicular to the rotation axis of the third rotating rack 13. The fourth guiding shaft 10 is rotatably mounted on the fourth rotating rack 14 in such a manner that the axis of the fourth guiding shaft 10 is perpendicular to the rotation axis of the fourth rotating rack 14. The rotation axes of the third rotating rack 13 and the fourth rotating rack 14 are vertically arranged. The second winding mandrel 4 is disposed between the third rotating rack 13 and the fourth rotating rack 14. By rotating the third rotating rack 13 and the fourth rotating rack 14, the guiding angles of the third guiding shaft 9 and the fourth guiding shaft 10 can be adjusted, such that rotation angle and turning angle of the reel belt 5 can be changed.

Referring to FIGS. 3-8, in a particular embodiment, the first base part 1 is arranged with a positioning seat 15, and the positioning seat 15 is mounted in the hemispherical cavity of the first base part 1. The drive assembly 6 comprises a drive shaft 601 rotatably mounted on the positioning seat 15, a first synchronous wheel 602 connected to and coaxially rotatable with the drive shaft 601, a second synchronous wheel 603 and a third synchronous wheel 604 which are rotatably mounted on the positioning seat 15, a first synchronous belt 605, a fourth synchronous wheel 606 mounted on the second winding mandrel 4 and synchronously rotatable with the second winding mandrel 4, a fifth synchronous wheel 607 and a sixth synchronous wheel 608 which are rotatably mounted on the second base part 3, and a second synchronous belt 609. The drive shaft 601 is connected to and coaxially rotatable with the first winding mandrel 2. The second synchronous wheel 603 is connected and synchronously rotatable with the fifth synchronous wheel 607. The third synchronous wheel 604 is connected and synchronously rotatable with the sixth synchronous wheel 608. When it is required to roll up the reel belt 5 by the first winding mandrel 2, the drive shaft 601 can be disconnected from the first synchronous wheel 602 and connected with the first winding mandrel 2. The drive shaft 601 can drive the first winding mandrel 2 to rotate and roll up the reel belt 5, such that the portion of the reel belt 5 which lie on the second winding mandrel 4 is pulled and released. When it is required to roll up the reel belt 5 by the second winding mandrel 4, the drive shaft 601 can be connected with the first synchronous wheel 602 and disconnected from the first winding mandrel 2. When the drive shaft 601 drives the first synchronous wheel 602 to rotate and roll up the reel belt 5, the first synchronous wheel 602 indirectly drives the third synchronous wheel to rotate, and then the third synchronous wheel leads the second winding mandrel 4 to rotate and roll up the reel belt 5, such that the portion of the reel belt 5 which lie on the first winding mandrel 2 can be pulled and released.

The first synchronous belt 605 is annular shaped and has one end engaged to the second synchronous wheel 603 and another end engaged to the third synchronous wheel 604. The first synchronous wheel 602 is located between the second synchronous wheel 603 and the third synchronous wheel 604, within the area surrounded by the first synchronous belt 605, and the first synchronous wheel 602 is engaged with an inside of the first synchronous belt 605.

The second synchronous belt 609 is annular shaped and has one end engaged to the fifth synchronous wheel 607 and another end engaged to the sixth synchronous wheel 608. The fourth synchronous wheel 606 is located between the fifth synchronous wheel 607 and the sixth synchronous wheel 608, within the area surrounded by the second synchronous belt 609, and the fourth synchronous wheel 606 is engaged with an inside of the second synchronous belt 609.

In a particular embodiment, the drive assembly 6 further comprises a slide 610 slideably mounted on the positioning seat 15. The slide 610 is slideable up and down in a direction along the axis of the drive shaft 601. The slide 610 is provided with a first limiting groove 6101, a first groove portion 6102, a second groove portion 6103, and a second limiting groove 6104. The first limiting groove 6101, the first groove portion 6102, the second groove portion 6103, and the second limiting groove 6104 are disposed and communicated in this order from bottom to top, in a direction along the axis of the drive shaft 601. The drive shaft 601 extends through the first limiting groove 6101, the first groove portion 6102, the second groove portion 6103, and the second limiting groove 6104 in this order. A first mounting seat 611 is disposed inside the first limiting groove 6101. A second mounting seat 612 is disposed inside the second limiting groove 6104. The first mounting seat 611 is rotatably mounted in the first limiting groove 6101. The drive shaft is provided at its circumference surface with a first engagement piece. The first mounting seat 611 is provided with a first slide chute for engagement with the first engagement piece, and the first slide chute extends through the first mounting seat 611 in a direction along the axis of the drive shaft. The first mounting seat 611 is rotatable about the axis of the drive shaft 601 and is slidable along with the slide 610. The first mounting seat is rotatable due to the first engagement piece, and is slidable up and down in a direction along the axis of the drive shaft. The second mounting seat 612 is rotatably mounted in the second limiting groove 6104. The drive shaft is provided at its circumference surface with a second engagement piece. The second mounting seat 612 is provided with a second slide chute for engagement with the second engagement piece, and the second slide chute extends through the second mounting seat 612 in a direction along the axis of the drive shaft. The second mounting seat 612 is rotatable about the axis of the drive shaft 601 and is slidable along with the slide 610. Due to the second engagement piece, the second mounting seat is rotatable, and the second mounting seat is slidable up and down in a direction along the axis of the drive shaft. The drive shaft 601 is provided at its outer circumference surface with two snap-in columns respectively disposed at two sides on the outer circumference surface of the drive shaft 601 in such a manner that the axis of the snap-in columns 613 is horizontally arranged. The snap-in columns 613 are located between the first mounting seat 611 and the second mounting seat 612. The upper end surface of the first winding mandrel 2 is fixedly arranged with a rotatable plate 621, which is fixedly connected to and coaxially rotatable with the first winding mandrel 2. The upper end surface of the rotatable plate 621 is provided with a first engagement groove (not shown in the drawings), and the lower end surface of the first mounting seat 611 is mounted with a first engagement piece 619 for engagement with the first engagement groove. The first synchronous wheel 602 is placed above the rotatable plate 621. The lower end surface of the first synchronous wheel 602 is provided with a second engagement groove (not shown in the drawings), and the upper end surface of the second mounting seat 612 is mounted with a second engagement piece 620 for engagement with the second engagement groove. When the slide 610 moves upward, the first engagement piece 619 is disengaged from the first engagement groove, and the second engagement piece 620 is engaged with the second engagement groove. In such a case, the drive shaft 601 drives the first synchronous wheel 602 to rotate. When the slide 610 moves downward, the second engagement piece 620 is disengaged from the second engagement groove, and the first engagement piece 619 is engaged with the first engagement groove. In such a case, the drive shaft 601 drives the rotatable plate 621 to rotate.

The wall formed between the first groove portion 6102 and the second groove portion 6103 is provided with communication paths 6105 for communicating the first groove portion 6102 with the second groove portion 6103. Two communication paths 6105 are provided and are in one-to-one correspondence with the two snap-in columns 613. The snap-in columns 613 are moveable between the first groove portion 6102 and the second groove portion 6103 via the communication paths 6105. The communication paths 6105 extends along the diameter direction of the drive shaft 601. Each of the communication paths 6105 has a first side wall and a second side wall which are opposite to each other. A first straight shaft (not shown in the drawings) is arranged on the first side wall, and the first straight shaft is sleeved with a first torsion spring (not shown in the drawings). A second straight shaft (not shown in the drawings) is arranged on the second side wall, and the second straight shaft is sleeved with a second torsion spring (not shown in the drawings). A first guiding plate 614 is mounted on the first straight shaft, with one end (the upper end) of the first guiding plate 614 being rotatably mounted on the first straight shaft and another end (the lower end) of the first guiding plate 614 extending into the first groove portion 6102. The distance from the wall formed between the first limiting groove 6101 and the first groove portion 6102 to the lower end of the first guiding plate 614 is less than the diameter of each of the snap-in columns 613. In the embodiment, the lower end of the first guiding plate 614 is tangent to the plane defined by the wall formed between the first limiting groove 6101 and the first groove portion 6102. The first guiding plate 614 is arranged to tilt towards the axis of the drive shaft 601. A second guiding plate 615 is mounted on the second straight shaft, with one end (the lower end) of the second guiding plate 615 being rotatably mounted on the second straight shaft and another end (the upper end) of the second guiding plate 615 extending into the second groove portion 6103. The distance from the wall formed between the second groove portion 6103 and the second limiting groove 6104 to the upper end of the second guiding plate 615 is less than the diameter of each of the snap-in columns 613. In the embodiment, the upper end of the second guiding plate 615 is tangent to the plane defined by the wall formed between the second limiting groove 6104 and the second groove portion 6103. The second guiding plate 615 is arranged to tilt towards the axis of the drive shaft 601. The first guiding plate 614 and the second guiding plate 615 are parallel to each other. One end of the first torsion spring is fixedly connected with the first side wall, and the other end of the first torsion spring is fixedly connected with the first guiding plate 614. One end of the second torsion spring is fixedly connected with the second side wall, and the other end of the second torsion spring is fixedly connected with the second guiding plate 615. Once the snap-in columns 613 are rotated to arrive at the lower end of the first guiding plate 614 when the snap-in columns 613 are driven to rotate in a clockwise direction in the first groove portion 6102, the snap-in columns 613 can be guided by the first guiding plate 614 to slide into the second groove portion 6103 and rotate in a clockwise direction in the second groove portion 6103, such that the slide 610 moves downward. When the snap-in columns 613 rotate in a clockwise direction in the second groove portion 6103, once the snap-in columns 613 get to the upper end of second guiding plate 615, the second torsion spring can be compressed and the upper end of the second guiding plate 615 can be rotated downward. In such a case, the snap-in columns 613 can travel over the second guiding plate 615 to continue rotating. Then, due to the second torsion spring, the upper end of the second guiding plate 615 can be rotated back upward. The above process is repeated during the rotation of the snap-in columns 613 in a clockwise direction in the second groove portion 6103. When the snap-in columns 613 rotate in the counter direction (the counter-clockwise direction) in the second groove portion 6103, once the snap-in columns 613 are rotated to arrive at the upper end of the second guiding plate 615, the snap-in columns 613 can be guided by the second guiding plate 615 to slide into the first groove portion 6102 and rotate in a counter-clockwise direction in the first groove portion 6102, such that the slide 610 moves upward. When the snap-in columns 613 rotate in a counter-clockwise direction in the first groove portion 6102, once the snap-in columns 613 get to the lower end of first guiding plate 614, the first torsion spring can be compressed and the lower end of the first guiding plate 614 can be rotated upward. In such a case, the snap-in columns 613 can travel over the first guiding plate 614 to continue rotating. Then, due to the first torsion spring, the lower end of the first guiding plate 614 can be rotated back downward. The above process is repeated during the rotation of the snap-in columns 613 in a counter-clockwise direction in the first groove portion 6102.

When the snap-in columns 613 is in the first groove portion 6102, the first engagement piece 619 is disengaged from the first engagement groove, and the second engagement piece 620 is engaged with the second engagement groove. When the snap-in columns 613 is in the second groove portion 6103, the first engagement piece 619 is engaged with the first engagement groove, and the second engagement piece 620 is disengaged from the second engagement groove.

In a particular embodiment, the lower end surface of the first mounting seat 611 is provided with a first mounting groove (not shown in the drawings), in which a first compression spring (not shown in the drawings) is mounted. One end of the first compression spring is fixedly connected with the bottom wall of the first mounting groove, and the other end of the first compression spring is fixedly connected with the first engagement piece 619. The upper end surface of the second mounting seat 612 is provided with a second mounting groove (not shown in the drawings), in which a second compression spring (not shown in the drawings) is mounted. One end of the second compression spring is fixedly connected with the bottom wall of the second mounting groove, and the other end of the second compression spring is fixedly connected with the second engagement piece 620.

In a particular embodiment, the roly-poly toy with adjustable center of gravity further comprises a mounting frame 16. The drive assembly 6 further comprises a first connecting column 616 and a second connecting column 617. The second synchronous wheel 603 is connected with the fifth synchronous wheel 607 by the first connecting column 616, and the third synchronous wheel 604 is connected with the sixth synchronous wheel 608 by the second connecting column 617. One end of the mounting frame 16 is fixedly connected with the second base part 3, and another end of the mounting frame 16 is fixedly connected with the positioning seat 15. The mounting frame 16 is provided with belt grooves which allow the reel belt 5 to pass along, a first column groove for mounting the first connecting column 616, and a second column groove for mounting the second connecting column 617. The positioning seat 15 is mounted in the hemispherical cavity of the first base part 1. The lower end of the mounting frame 16 is attached to the upper surface of the positioning seat 15, and the upper end of the mounting frame 16 is connected with the second base part 3. The first connecting column 616 is rotatably mounted in the first column groove, and the second connecting column 617 is rotatably mounted in the second column groove. Two belt grooves are located respectively on two sides of the axis of the drive shaft 601, and the reel belt 5 is slidable up and down in the belt grooves at two the sides.

In a particular embodiment, the drive assembly 6 further comprises handles 618 rotatably mounted on the positioning seat 15, and the handles 618 are connected to and coaxially rotatable with the drive shaft 601. The upper surface of the positioning seat 15 is provided with circular recesses, in which the handles 618 are rotatably mounted, respectively. The upper end of the drive shaft 601 is connected with the handles 618, such that the drive shaft 601 rotates rotate along with the handles 618.

In a particular embodiment, the roly-poly toy with adjustable center of gravity further comprises a dust cover 17, and the dust cover 17 is covered on the second base part 3.

In a particular embodiment, the roly-poly toy with adjustable center of gravity further comprises a stop block. The second end of the reel belt 5 is located between the stop block and the second base part 3. The lower end of the second winding mandrel 4 is mounted on the second base part 3, and the stop block is disposed at the upper end of the second winding mandrel 4.

The working principle of the embodiments of the disclosure is as follows.

When it is required to transfer the gravity force acting on the second base part of the roly-poly toy to the first base part in the first adjustment mode, the handles can be rotated in clockwise direction to drive the snap-in columns to rotate in the second groove portion, until the first engagement piece is engaged in the first engagement groove and the second engagement piece is disengaged from the second engagement groove. In such a manner, the first winding mandrel can be directly driven to rotate and roll up the reel belt by driving the rotatable plate to rotate by the handles. Due to the first winding mandrel which pulls the reel belt, the portion of the reel belt wound around the second winding mandrel can be automatically released. As the second winding mandrel is rotated to release the reel belt, the fourth synchronous wheel is driven to rotate and indirectly drives the first synchronous wheel to rotate. Hence, the gravity force acting on the second base part can be transferred to the first base part.

When it is required to transfer the gravity force acting on the first base part of the roly-poly toy to the second base part in the second adjustment mode, the handles can be rotated in counter-clockwise direction to drive the snap-in columns to rotate in the second groove portion. When the snap-in columns are rotated to arrive at the communication paths in the second groove portion, the snap-in columns can be guided by the first guiding plate and the second guiding plate to slide into the first groove portion and slide therein. During the process, the slide is driven by the snap-in columns to move upward, until the second engagement piece is engaged in the second engagement groove of the first synchronous wheel, and the first engagement piece is disengaged from the first engagement groove. In such a manner, the first synchronous wheel, which is directly driven to rotate by the handles, can drive the fourth synchronous wheel to rotate, such that the fourth synchronous wheel can drive the second winding mandrel to rotate and actively roll up the reel belt. In such a manner, the portion of the reel belt wound around the second winding mandrel is pulled and can be automatically released. Hence, the gravity force acting on the first base part can be transferred to the second base part.

If it is required to transfer the gravity force acting on the second base part of the roly-poly toy to the first base part again, the handles can be rotated in clockwise direction, to allow the snap-in columns which rotate in clockwise direction in the second groove portion to arrive at the communication paths. Then, the snap-in columns can be guided by the first guiding plate and the second guiding plate to return into the second groove portion and continue rotating therein. During the process, the slide moves downward, until the first engagement piece is engaged in the first engagement groove, and the second engagement piece is disengaged from the second engagement groove, switching into the first adjustment mode.

All the above are merely some preferred embodiments of the disclosure. It should be noted that the disclosure is intended to cover various modifications and equivalent arrangements included within the principle of the disclosure made by those skilled in the art.

The invention claimed is:

1. A roly-poly toy with adjustable center of gravity, comprising: a first base part, a first winding mandrel rotatably mounted on the first base part, a second base part, a second winding mandrel rotatably mounted on the second base part, a reel belt, and a drive assembly; wherein the first base part and the second base part are arranged at an interval, the reel belt is annular and has a first end wound around the first winding mandrel and a second end wound around the second winding mandrel;

wherein the drive assembly is configured to switch between a first driving state and a second driving state, when the drive assembly is in the first driving state, the first winding mandrel rotates to roll up the reel belt, and the second winding mandrel rotates to release the reel belt, and when the drive assembly is in the second driving state, the second winding mandrel rotates to roll up the reel belt, and the first winding mandrel rotates to release the reel belt.

2. The roly-poly toy with adjustable center of gravity according to claim 1, further comprising a first guiding shaft and a second guiding shaft, both of which are mounted on the first base part, wherein the first winding mandrel is disposed between the first guiding shaft and the second guiding shaft, the reel belt on one side at the first end extends over the first guiding shaft and abuts against a circumference surface of the first guiding shaft, and the reel belt on another side at the first end extends over the second guiding shaft and abuts against a circumference surface of the second guiding shaft.

3. The roly-poly toy with adjustable center of gravity according to claim 2, further comprising a first rotating rack and a second rotating rack, both of which are rotatably mounted on the first base part, a rotation axis of the first winding mandrel, a rotation axis of the first rotating rack, and a rotation axis of the second rotating rack are parallel to each other, the first guiding shaft is mounted on the first rotating rack in such a manner that an axis of the first guiding shaft is perpendicular to the rotation axis of the first rotating rack, and the second guiding shaft is mounted on the second rotating rack in such a manner that an axis of the second guiding shaft is perpendicular to the rotation axis of the second rotating rack.

4. The roly-poly toy with adjustable center of gravity according to claim 3, further comprising a stop block, and a second end of the reel belt is located between the stop block and the second base part.

5. The roly-poly toy with adjustable center of gravity according to claim 2, further comprising a stop block, and a second end of the reel belt is located between the stop block and the second base part.

6. The roly-poly toy with adjustable center of gravity according to claim 1, further comprising a third guiding shaft and a fourth guiding shaft, both of which are mounted on the second base part, wherein the second winding mandrel is disposed between the third guiding shaft and the fourth guiding shaft, the reel belt on one side at the second end extends over the third guiding shaft and abuts against a circumference surface of the third guiding shaft, and the reel belt on another side at the second end extends over the fourth guiding shaft and abuts against a circumference surface of the fourth guiding shaft.

7. The roly-poly toy with adjustable center of gravity according to claim 6, further comprising a stop block, and a second end of the reel belt is located between the stop block and the second base part.

8. The roly-poly toy with adjustable center of gravity according to claim 6, further comprising a third rotating rack and a fourth rotating rack, both of which are rotatably mounted on the second base part, a rotation axis of the second winding mandrel, a rotation axis of the third rotating rack, and a rotation axis of the fourth rotating rack are parallel to each other, the third guiding shaft is mounted on the third rotating rack in such a manner that an axis of the third guiding shaft is perpendicular to the rotation axis of the third rotating rack, and the fourth guiding shaft is mounted on the fourth rotating rack in such a manner that an axis of the fourth guiding shaft is perpendicular to the rotation axis of the fourth rotating rack.

9. The roly-poly toy with adjustable center of gravity according to claim 8, further comprising a stop block, and a second end of the reel belt is located between the stop block and the second base part.

10. The roly-poly toy with adjustable center of gravity according to claim 1, wherein the first base part is arranged with a positioning seat, the drive assembly comprises a drive shaft rotatably mounted on the positioning seat, a first synchronous wheel connected to and coaxially rotatable with the drive shaft, a second synchronous wheel and a third synchronous wheel which are rotatably mounted on the positioning seat, a first synchronous belt, a fourth synchronous wheel mounted on the second winding mandrel and synchronously rotatable with the second winding mandrel, a fifth synchronous wheel and a sixth synchronous wheel which are rotatably mounted on the second base part, and a second synchronous belt; the drive shaft is connected to and coaxially rotatable with the first winding mandrel, the second synchronous wheel is connected and synchronously rotatable with the fifth synchronous wheel, and the third synchronous wheel is connected and synchronously rotatable with the sixth synchronous wheel;

wherein the first synchronous belt is annular shaped and has one end engaged to the second synchronous wheel and another end engaged to the third synchronous wheel, the first synchronous wheel is located between the second synchronous wheel and the third synchronous wheel, within an area surrounded by the first synchronous belt, and the first synchronous wheel is engaged with an inside of the first synchronous belt; and wherein the second synchronous belt is annular shaped and has one end engaged to the fifth synchronous wheel and another end engaged to the sixth synchronous wheel, the fourth synchronous wheel is located between the fifth synchronous wheel and the sixth synchronous wheel, within an area surrounded by the second synchronous belt, and the fourth synchronous wheel is engaged with an inside of the second synchronous belt.

11. The roly-poly toy with adjustable center of gravity according to claim 10, wherein the drive assembly further comprises a slide slideably mounted on the positioning seat, the slide is slideable in a direction along an axis of the drive shaft, the slide is provided with a first limiting groove, a first groove portion, a second groove portion, and a second limiting groove, which are disposed and in communication in this order in the direction along the axis of the drive shaft, the drive shaft extends through the first limiting groove, the first groove portion, the second groove portion, and the second limiting groove in this order; a first mounting seat is disposed inside the first limiting groove, a second mounting seat is disposed inside the second limiting groove, the first mounting seat is rotatably mounted in the first limiting groove, the second mounting seat is rotatably mounted in the second limiting groove, wherein the drive shaft is provided at a circumference surface with a snap-in column located between the first mounting seat and the second mounting seat, the first winding mandrel is arranged with a rotatable plate which is fixedly connected to and coaxially rotatable with the first winding mandrel, an end surface of the rotatable plate is provided with a first engagement groove, an end surface of the first synchronous wheel is provided with a second engagement groove, the first mounting seat is arranged with a first engagement piece for engagement with the first engagement groove, and the second mounting seat is arranged with a second engagement piece for engagement with the second engagement groove;

a wall formed between the first groove portion and the second groove portion is provided with a communication path for communicating the first groove portion with the second groove portion, the communication path has a first side wall and a second side wall which are opposite to each other, a first straight shaft is arranged on the first side wall and is sleeved with a first torsion spring, a second straight shaft is arranged on the second side wall and is sleeved with a second torsion spring, a first guiding plate is mounted on the first straight shaft, with one end of the first guiding plate being rotatably mounted on the first straight shaft and another end of the first guiding plate extending into the first groove portion, a distance from a wall formed between the first limiting groove and the first groove portion to the first guiding plate is less than a diameter of the snap-in column, and the first guiding plate is arranged to tilt towards the axis of the drive shaft; wherein a second guiding plate is mounted on the second straight shaft, with one end of the second guiding plate being rotatably mounted on the second straight shaft and another end of the second guiding plate extending into the second groove portion, a distance from a wall formed between the second groove portion and the second limiting groove to the second guiding plate is less than the diameter of the snap-in column, and the second guiding plate is arranged to tilt towards the axis of the drive shaft;

the first guiding plate and the second guiding plate are parallel to each other, one end of the first torsion spring is fixedly connected with the first side wall, and another end of the first torsion spring is fixedly connected with the first guiding plate, one end of the second torsion spring is fixedly connected with the second side wall, and another end of the second torsion spring is fixedly connected with the second guiding plate;

wherein the snap-in column is movable between the first groove portion and the second groove portion via the communication path, and when the snap-in column is located in the first groove portion, the first engagement piece is disengaged from the first engagement groove and the second engagement piece is engaged within the second engagement groove; and when the snap-in column is located in the second groove portion, the first engagement piece is engaged within the first engagement groove, and the second engagement piece is disengaged from the second engagement groove.

12. The roly-poly toy with adjustable center of gravity according to claim 11, further comprising a stop block, and a second end of the reel belt is located between the stop block and the second base part.

13. The roly-poly toy with adjustable center of gravity according to claim 11, wherein an end surface of the first mounting seat is provided with a first mounting groove, in which a first compression spring is mounted, with one end of the first compression spring being fixedly connected with a bottom wall of the first mounting groove, and another end of the first compression spring being fixedly connected with the first engagement piece, an end surface of the second mounting seat is provided with a second mounting groove, in which a second compression spring is mounted, with one end of the second compression spring being fixedly connected with a bottom wall of the second mounting groove, and another end of the second compression spring being fixedly connected with the second engagement piece.

14. The roly-poly toy with adjustable center of gravity according to claim 13, further comprising a stop block, and a second end of the reel belt is located between the stop block and the second base part.

15. The roly-poly toy with adjustable center of gravity according to claim 10, further comprising a mounting frame, wherein the drive assembly further comprises a first connecting column and a second connecting column, the second synchronous wheel is connected with the fifth synchronous wheel by the first connecting column, and the third synchronous wheel is connected with the sixth synchronous wheel by the second connecting column, one end of the mounting frame is fixedly connected with the second base part, and another end of the mounting frame is fixedly connected with the positioning seat, the mounting frame is provided with a belt groove which allows the reel belt to pass along, a first column groove for mounting the first connecting column, and a second column groove for mounting the second connecting column.

16. The roly-poly toy with adjustable center of gravity according to claim 15, further comprising a stop block, and a second end of the reel belt is located between the stop block and the second base part.

17. The roly-poly toy with adjustable center of gravity according to claim 10, wherein the drive assembly further comprises a handle rotatably mounted on the positioning seat, and the handle is connected to and coaxially rotatable with the drive shaft.

18. The roly-poly toy with adjustable center of gravity according to claim 10, further comprising a stop block, and a second end of the reel belt is located between the stop block and the second base part.

19. The roly-poly toy with adjustable center of gravity according to claim 1, further comprising a dust cover covered on the second base part.

20. The roly-poly toy with adjustable center of gravity according to claim 1, further comprising a stop block, and a second end of the reel belt is located between the stop block and the second base part.

* * * * *